US010920148B2

(12) United States Patent
Quanci et al.

(10) Patent No.: US 10,920,148 B2
(45) **Date of Patent: *Feb. 16, 2021**

(54) BURN PROFILES FOR COKE OPERATIONS

(71) Applicant: SUNCOKE TECHNOLOGY AND DEVELOPMENT LLC, Lisle, IL (US)

(72) Inventors: John Francis Quanci, Haddonfield, NJ (US); Parthasarathy Kesavan, Lisle, IL (US); Ung-Kyung Chun, Lisle, IL (US); Rajesh Kumar Kandula, Lisle, IL (US); Mayela Carolina Fernandez, Lisle, IL (US); Khambath Vichitvongsa, Granite City, IL (US); Jeffrey Scott Brombolich, Granite City, IL (US); Richard Alan Mrozowicz, Granite City, IL (US); Edward A. Glass, Granite City, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/428,014

(22) Filed: May 31, 2019

(65) Prior Publication Data

US 2020/0157430 A1 May 21, 2020

Related U.S. Application Data

(62) Division of application No. 14/839,551, filed on Aug. 28, 2015, now Pat. No. 10,308,876.

(Continued)

(51) Int. Cl.

*C10B 15/02* (2006.01)
*C10B 21/10* (2006.01)

(Continued)

(52) U.S. Cl.

CPC ..... *C10B 25/02* (2013.01); *C10B 15/02* (2013.01); *C10B 31/00* (2013.01); *C10B 31/02* (2013.01);

(Continued)

(58) Field of Classification Search

CPC ..... C10B 15/02; C10B 21/10; C10B 15/00; C10B 25/02; C10B 31/00; C10B 31/02;

(Continued)

(56) References Cited

U.S. PATENT DOCUMENTS 425,797 A 4/1890 Hunt
469,868 A 3/1892 Osbourn (Continued)

FOREIGN PATENT DOCUMENTS

CA 1172895 8/1984
CA 2775992 5/2011

(Continued)

OTHER PUBLICATIONS

U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.

(Continued)

*Primary Examiner* — Jonathan Luke Pilcher
(74) *Attorney, Agent, or Firm* — Perkins Coie LLP

(57) ABSTRACT

The present technology is generally directed to systems and methods for optimizing the burn profiles for coke ovens, such as horizontal heat recovery ovens. In various embodiments the burn profile is at least partially optimized by controlling air distribution in the coke oven. In some embodiments, the air distribution is controlled according to temperature readings in the coke oven. In particular embodiments, the system monitors the crown temperature of the (Continued)

coke oven. After the crown reaches a particular temperature range the flow of volatile matter is transferred to the sole flue to increase sole flue temperatures throughout the coking cycle. Embodiments of the present technology include an air distribution system having a plurality of crown air inlets positioned above the oven floor.

5 Claims, 13 Drawing Sheets

Related U.S. Application Data

(60) Provisional application No. 62/043,359, filed on Aug. 28, 2014.

(51) Int. Cl.

| | |
|---|---|
| ***C10B 25/02*** | (2006.01) |
| ***C10B 31/06*** | (2006.01) |
| ***C10B 31/08*** | (2006.01) |
| ***C10B 37/02*** | (2006.01) |
| ***C10B 35/00*** | (2006.01) |
| ***C10B 41/00*** | (2006.01) |
| ***C10B 31/02*** | (2006.01) |
| ***C10B 37/04*** | (2006.01) |
| ***C10B 39/06*** | (2006.01) |
| ***C10B 31/10*** | (2006.01) |
| ***C10B 57/08*** | (2006.01) |
| ***C10B 31/00*** | (2006.01) |
| ***C10B 57/02*** | (2006.01) |
| *C10B 5/00* | (2006.01) |
| *C10B 15/00* | (2006.01) |

(52) U.S. Cl.
CPC ..... *C10B 31/06* (2013.01); *C10B 31/08* (2013.01); *C10B 31/10* (2013.01); *C10B 35/00* (2013.01); *C10B 37/02* (2013.01); *C10B 37/04* (2013.01); *C10B 39/06* (2013.01); *C10B 41/00* (2013.01); *C10B 57/02* (2013.01); *C10B 57/08* (2013.01); *C10B 5/00* (2013.01); *C10B 15/00* (2013.01); *C10B 21/10* (2013.01)

(58) Field of Classification Search
CPC ..... C10B 31/06; C10B 31/08; C10B 31/10; C10B 35/00; C10B 37/02; C10B 37/04; C10B 39/06; C10B 41/00; C10B 57/02; C10B 57/08; C01B 5/00
See application file for complete search history.

(56) References Cited

U.S. PATENT DOCUMENTS 845,719 A 2/1907 Schniewind
976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,947,499 A 2/1934 Schrader et al.
1,955,962 A 4/1934 Jones
2,075,337 A 3/1937 Burnaugh
2,141,035 A 12/1938 Daniels
2,195,466 A 4/1940 Otto
2,394,173 A 2/1946 Harris et al.
2,424,012 A 7/1947 Bangham et al.
2,649,978 A 8/1953 Such
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
3,015,893 A 1/1962 McCreary
3,033,764 A 5/1962 Hannes
3,224,805 A 12/1965 Clyatt
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobie et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,984,289 A 10/1976 Sustarsic et al.
4,004,702 A 1/1977 Szendroi
4,004,983 A 1/1977 Pries
4,025,395 A 5/1977 Ekholm et al.
4,040,910 A 8/1977 Knappstein et al.
4,045,299 A 8/1977 McDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Carimboli
4,124,450 A 11/1978 MacDonald
4,135,948 A 1/1979 Mertens et al.
4,141,796 A 2/1979 Clark et al.
4,145,195 A 3/1979 Knappstein et al.
4,147,230 A 4/1979 Ormond et al.
4,162,546 A 7/1979 Shortell et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy

(56) References Cited

U.S. PATENT DOCUMENTS 4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,584 A 9/1981 Chuss et al.
4,289,585 A 9/1981 Wagener et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,704,195 A 11/1987 Janicka et al.
4,720,262 A 1/1988 Durr et al.
4,724,976 A 2/1988 Lee
4,726,465 A 2/1988 Kwasnik et al.
4,793,981 A 12/1988 Doyle et al.
4,824,614 A 4/1989 Jones et al.
4,889,698 A 12/1989 Moller et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,423,152 A 6/1995 Kolvek
5,447,606 A 9/1995 Pruitt
5,480,594 A 1/1996 Wilkerson et al.
5,542,650 A 8/1996 Abel et al.
5,622,280 A 4/1997 Mays et al.
5,659,110 A 8/1997 Herden et al.
5,670,025 A 9/1997 Baird
5,687,768 A 11/1997 Albrecht et al.
5,715,962 A 2/1998 McDonnell
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,913,448 A 6/1999 Mann et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,412,221 B1 7/2002 Emsbo
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,611,609 B1 11/2009 Valia et al.
7,644,711 B2 1/2010 Creel
7,722,843 B1 5/2010 Srinivasachar
7,727,307 B2 6/2010 Winkler
7,785,447 B2 8/2010 Eatough et al.
7,803,627 B2 9/2010 Hodges et al.
7,823,401 B2 11/2010 Takeuchi et al.
7,827,689 B2 11/2010 Crane
7,998,316 B2 8/2011 Barkdoll
8,071,060 B2 12/2011 Ukai et al.
8,079,751 B2 12/2011 Kapila et al.
8,080,088 B1 12/2011 Srinivasachar
8,152,970 B2 4/2012 Barkdoll et al.
8,236,142 B2 8/2012 Westbrook
8,266,853 B2 9/2012 Bloom et al.
8,398,935 B2 3/2013 Howell et al.
8,409,405 B2 4/2013 Kim et al.
8,647,476 B2 2/2014 Kim et al.
8,800,795 B2 8/2014 Hwang
8,956,995 B2 2/2015 Masatsugu et al.
8,980,063 B2 3/2015 Kim et al.
9,039,869 B2 5/2015 Kim et al.
9,057,023 B2 6/2015 Reichelt et al.
9,193,915 B2 11/2015 West et al.
9,238,778 B2 1/2016 Quanci et al.
9,243,186 B2 1/2016 Quanci et al.
9,249,357 B2 2/2016 Quanci et al.
9,359,554 B2 6/2016 Quanci et al.
9,580,656 B2 2/2017 Quanci et al.

(56) References Cited

U.S. PATENT DOCUMENTS

| | | | |
|---|---|---|---|
| 9,672,499 | B2 | 6/2017 | Quanci et al. |
| 9,708,542 | B2 | 7/2017 | Quanci et al. |
| 9,862,888 | B2 | 1/2018 | Quanci et al. |
| 9,976,089 | B2 | 5/2018 | Quanci et al. |
| 10,016,714 | B2 | 7/2018 | Quanci et al. |
| 10,041,002 | B2 | 8/2018 | Quanci et al. |
| 10,047,296 | B2 | 8/2018 | Chun et al. |
| 10,053,627 | B2 | 8/2018 | Sarpen et al. |
| 10,233,392 | B2 | 3/2019 | Quanci et al. |
| 10,308,876 | B2 | 6/2019 | Quanci et al. |
| 10,323,192 | B2 | 6/2019 | Quanci et al. |
| 2002/0170605 | A1 | 11/2002 | Shiraishi et al. |
| 2003/0014954 | A1 | 1/2003 | Ronning et al. |
| 2003/0015809 | A1 | 1/2003 | Carson |
| 2003/0057083 | A1 | 3/2003 | Eatough et al. |
| 2005/0087767 | A1 | 4/2005 | Fitzgerald et al. |
| 2006/0102420 | A1 | 5/2006 | Huber et al. |
| 2006/0149407 | A1 | 7/2006 | Markham et al. |
| 2007/0116619 | A1 | 5/2007 | Taylor et al. |
| 2007/0251198 | A1 | 11/2007 | Witter |
| 2008/0028935 | A1 | 2/2008 | Andersson |
| 2008/0179165 | A1 | 7/2008 | Chen et al. |
| 2008/0257236 | A1 | 10/2008 | Green |
| 2008/0271985 | A1 | 11/2008 | Yamasaki |
| 2008/0289305 | A1 | 11/2008 | Girondi |
| 2009/0007785 | A1 | 1/2009 | Kimura et al. |
| 2009/0152092 | A1 | 6/2009 | Kim et al. |
| 2009/0162269 | A1 | 6/2009 | Barger et al. |
| 2009/0217576 | A1 | 9/2009 | Kim et al. |
| 2009/0283395 | A1 | 11/2009 | Hippe |
| 2010/0095521 | A1 | 4/2010 | Kartal et al. |
| 2010/0106310 | A1 | 4/2010 | Grohman |
| 2010/0113266 | A1 | 5/2010 | Abe et al. |
| 2010/0115912 | A1 | 5/2010 | Worley |
| 2010/0181297 | A1 | 7/2010 | Whysail |
| 2010/0196597 | A1 | 8/2010 | Di Loreto |
| 2010/0276269 | A1 | 11/2010 | Schuecker et al. |
| 2010/0287871 | A1 | 11/2010 | Bloom et al. |
| 2010/0300867 | A1 | 12/2010 | Kim et al. |
| 2010/0314234 | A1 | 12/2010 | Knoch et al. |
| 2011/0048917 | A1 | 3/2011 | Kim et al. |
| 2011/0088600 | A1 | 4/2011 | McRae |
| 2011/0120852 | A1 | 5/2011 | Kim |
| 2011/0144406 | A1 | 6/2011 | Masatsugu et al. |
| 2011/0168482 | A1 | 7/2011 | Merchant et al. |
| 2011/0174301 | A1 | 7/2011 | Haydock et al. |
| 2011/0192395 | A1 | 8/2011 | Kim |
| 2011/0198206 | A1 | 8/2011 | Kim et al. |
| 2011/0223088 | A1 | 9/2011 | Chang et al. |
| 2011/0253521 | A1 | 10/2011 | Kim |
| 2011/0291827 | A1 | 12/2011 | Baldocchi et al. |
| 2011/0313218 | A1 | 12/2011 | Dana |
| 2011/0315538 | A1 | 12/2011 | Kim et al. |
| 2012/0024688 | A1 | 2/2012 | Barkdoll |
| 2012/0030998 | A1 | 2/2012 | Barkdoll et al. |
| 2012/0125709 | A1 | 5/2012 | Merchant et al. |
| 2012/0152720 | A1 | 6/2012 | Reichelt et al. |
| 2012/0180133 | A1 | 7/2012 | Ai-Harbi et al. |
| 2012/0228115 | A1 | 9/2012 | Westbrook |
| 2012/0247939 | A1 | 10/2012 | Kim et al. |
| 2012/0305380 | A1 | 12/2012 | Wang et al. |
| 2013/0020781 | A1 | 1/2013 | Kishikawa |
| 2013/0045149 | A1 | 2/2013 | Miller |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0208997 | A1 | 7/2014 | Alferyev et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0247092 | A1 | 9/2015 | Quanci et al. |
| 2015/0361346 | A1 | 12/2015 | West et al. |
| 2015/0361347 | A1 | 12/2015 | Ball et al. |
| 2016/0026193 | A1 | 1/2016 | Rhodes et al. |
| 2016/0048139 | A1 | 2/2016 | Samples et al. |
| 2016/0149944 | A1 | 5/2016 | Obermeirer et al. |
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2016/0319197 | A1 | 11/2016 | Quanci et al. |
| 2016/0319198 | A1 | 11/2016 | Quanci et al. |
| 2017/0015908 | A1 | 1/2017 | Quanci et al. |
| 2017/0137714 | A1 | 5/2017 | West et al. |
| 2017/0183569 | A1 | 6/2017 | Quanci et al. |
| 2017/0253803 | A1 | 9/2017 | West et al. |
| 2017/0352243 | A1 | 12/2017 | Quanci et al. |
| 2018/0340122 | A1 | 11/2018 | Crum et al. |
| 2019/0099708 | A1 | 4/2019 | Quanci |
| 2019/0161682 | A1 | 5/2019 | Quanci et al. |
| 2019/0169503 | A1 | 6/2019 | Chun et al. |

FOREIGN PATENT DOCUMENTS

| | | | |
|---|---|---|---|
| CA | 2822841 | | 7/2012 |
| CA | 2822857 | | 7/2012 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 103468289 | A | 12/2013 |
| CN | 105189704 | A | 12/2015 |
| CN | 106661456 | A | 5/2017 |
| DE | 201729 | C | 9/1908 |
| DE | 212176 | | 7/1909 |
| DE | 1212037 | B | 3/1966 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | | 12/2007 |
| DE | 102009031436 | | 1/2011 |

(56) References Cited

FOREIGN PATENT DOCUMENTS

| | | | |
|---|---|---|---|
| DE | 102011052785 | | 12/2012 |
| EP | 0126399 | A1 | 11/1984 |
| EP | 0208490 | | 1/1987 |
| EP | 0903393 | A2 | 3/1999 |
| EP | 1538503 | A1 | 6/2005 |
| EP | 2295129 | | 3/2011 |
| FR | 2339664 | | 8/1977 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 12/1975 |
| JP | S59019301 | | 2/1978 |
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H0649450 | A | 2/1994 |
| JP | H0654753 | U | 7/1994 |
| JP | H06264062 | | 9/1994 |
| JP | 07188668 | | 7/1995 |
| JP | 07216357 | | 8/1995 |
| JP | H07204432 | | 8/1995 |
| JP | H08104875 | A | 4/1996 |
| JP | 08127778 | | 5/1996 |
| JP | H10273672 | A | 10/1998 |
| JP | H11-131074 | | 5/1999 |
| JP | 2000204373 | A | 7/2000 |
| JP | 2001200258 | | 7/2001 |
| JP | 2002106941 | | 4/2002 |
| JP | 2003041258 | | 2/2003 |
| JP | 2003071313 | A | 3/2003 |
| JP | 2003292968 | A | 10/2003 |
| JP | 2003342581 | A | 12/2003 |
| JP | 2005503448 | A | 2/2005 |
| JP | 2005263983 | A | 9/2005 |
| JP | 2006188608 | A | 7/2006 |
| JP | 2007063420 | A | 3/2007 |
| JP | 4101226 | B2 | 6/2008 |
| JP | 2008231278 | A | 10/2008 |
| JP | 2009073864 | A | 4/2009 |
| JP | 2009073865 | A | 4/2009 |
| JP | 2009144121 | | 7/2009 |
| JP | 2010229239 | A | 10/2010 |
| JP | 2010248389 | A | 11/2010 |
| JP | 2012102302 | | 5/2012 |
| JP | 2013006957 | A | 1/2013 |
| JP | 2013510910 | | 3/2013 |
| JP | 2014040502 | A | 3/2014 |
| KR | 1019960008754 | | 10/1996 |
| KR | 1019990054426 | | 7/1999 |
| KR | 20000042375 | A | 7/2000 |
| KR | 100296700 | B1 | 10/2001 |
| KR | 1020050053861 | A | 6/2005 |
| KR | 100737393 | B1 | 7/2007 |
| KR | 100797852 | | 1/2008 |
| KR | 20110010452 | A | 2/2011 |
| KR | 101314288 | | 4/2011 |
| KR | 20130050807 | | 5/2013 |
| KR | 101318388 | | 10/2013 |
| RU | 2083532 | C1 | 7/1997 |
| RU | 2441898 | C2 | 2/2012 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO2005023649 | | 3/2005 |
| WO | WO2005115583 | | 12/2005 |
| WO | WO2007103649 | | 9/2007 |
| WO | WO2008034424 | | 3/2008 |
| WO | WO2011000447 | | 1/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |

OTHER PUBLICATIONS

U.S. Appl. No. 16/026,363, filed Jul. 3, 2018, titled Non-Perpendicular Connections Between Coke Oven Uptakes and a Hot Common Tunnel, and Associated Systems and Methods.

U.S. Appl. No. 13/730,796, filed Dec. 28, 2012, titled Methods and Systems for Improved Coke Quenching.

U.S. Appl. No. 13/730,598, filed Dec. 28, 2012, now U.S. Pat. No. 9,238,778, titled Systems and Methods for Improving Quenched Coke Recovery.

U.S. Appl. No. 14/952,267, filed Nov. 25, 2015, now U.S. Pat. No. 9,862,888, titled Systems and Methods for Improving Quenched Coke Recovery.

U.S. Appl. No. 15/830,320, filed Dec. 4, 2017, titled Systems and Methods for Improving Quenched Coke Recovery.

U.S. Appl. No. 07/587,742, filed Sep. 25, 1990, now U.S. Pat. No. 5,114,542, titled Nonrecovery Coke Oven Battery and Method of Operation.

U.S. Appl. No. 07/878,904, filed May 6, 1992, now U.S. Pat. No. 5,318,671, titled Method of Operation of Nonrecovery Coke Oven Battery.

U.S. Appl. No. 09/783,195, filed Feb. 14, 2001, now U.S. Pat. No. 6,596,128, titled Coke Oven Flue Gas Sharing.

U.S. Appl. No. 07/886,804, filed May 22, 1992, now U.S. Pat. No. 5,228,955, titled High Strength Coke Oven Wall Having Gas Flues Therein.

U.S. Appl. No. 08/059,673, filed May 12, 1993, now U.S. Pat. No. 5,447,606, titled Method of and Apparatus for Capturing Coke Oven Charging Emissions.

U.S. Appl. No. 08/914,140, filed Aug. 19, 1997, now U.S. Pat. No. 5,928,476, titled Nonrecovery Coke Oven Door.

U.S. Appl. No. 09/680,187, filed Oct. 5, 2000, now U.S. Pat. No. 6,290,494, titled Method and Apparatus for Coal Coking.

U.S. Appl. No. 10/933,866, filed Sep. 3, 2004, now U.S. Pat. No. 7,331,298, titled Coke Oven Rotary Wedge Door Latch.

U.S. Appl. No. 11/424,566, filed Jun. 16, 2006, now U.S. Pat. No. 7,497,930, titled Method and Apparatus for Compacting Coal for a Coal Coking Process.

U.S. Appl. No. 12/405,269, filed Mar. 17, 2009, now U.S. Pat. No. 7,998,316, titled Flat Push Coke Wet Quenching Apparatus and Process.

U.S. Appl. No. 13/205,960, filed Aug. 9, 2011, now U.S. Pat. No. 9,321,965, titled Flat Push Coke Wet Quenching Apparatus and Process.

(56) References Cited

OTHER PUBLICATIONS

U.S. Appl. No. 11/367,236, filed Mar. 3, 2006, now U.S. Pat. No. 8,152,970, titled Method and Apparatus For Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, filed Jun. 24, 2015, titled Systems and Methods for Removing Mercury From Emissions.
U.S. Appl. No. 16/000,516, filed June 5, 2018, titled Systems and Methods for Removing Mercury From Emissions.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 16/704,689, filed Dec. 5, 2019, titled Horizontal Heat Recovery Coke Ovens Having Monolith Crowns.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, now U.S. Pat. No. 10,041,002, titled Coke Plant Including Exhaust Gas Sharing, now U.S. Pat. No. 10,041,002.
U.S. Appl. No. 16/047,198, filed Jul. 27, 2018, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, titled Coke Oven Charging System.
U.S. Appl. No. 15/443,246, now U.S. Pat. No. 9,976,089, filed Feb. 27, 2017, titled Coke Oven Charging System.
U.S. Appl. No. 14/587,670, filed Dec. 31, 2014, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/987,860, filed May 23, 2018, titled System and Method for Repairing a Coke Oven.
U.S. Appl. No. 16/729,053, filed Dec. 27, 2019, titled Oven Uptakes.
U.S. Appl. No. 16/729,036, filed Dec. 27, 2019, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, titled Methods and Systems for Providing Corrosion Resistant Surfaces In Contaminant Treatment Systems.
U.S. Appl. No. 16/729,068, filed Dec. 27, 2019, titled Systems and Methods for Utilizing Flue Gas.
U.S. Appl. No. 16/729,129, filed Dec. 27, 2019, titled Coke Plant Tunnel Repair and Flexible Joints.
U.S. Appl. No. 16/729,170, filed Dec. 27, 2019, titled Coke Plant Tunnel Repair and Anchor Distribution.
U.S. Appl. No. 16/729,157, filed Dec. 27, 2019, titled Particulate Detection for Industrial Facilities, and Associated Systems and Methods.
U.S. Appl. No. 16/729,057, filed Dec. 27, 2019, titled Decarbonization of Coke Ovens and Associated Systems and Methods.
U.S. Appl. No. 16/729,212, filed Dec. 27, 2019, titled Heat Recovery Oven Foundation.
U.S. Appl. No. 16/729,219, filed Dec. 27, 2019, titled Spring-Loaded Heat Recovery Oven System and Method.
U.S. Appl. No. 16/251,352, filed Jan. 18, 2019, Quanci et al.
ASTM D5341-99(2010)e1, Standard Test Method for Measuring Coke Reactivity Index (CRI) and Coke Strength After Reaction (CSR), ASTM International, West Conshohocken, PA, 2010.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf ; 404 pages.
Basset et al., "Calculation of steady flow pressure loss coefficients for pipe junctions," Proc Instn Mech Engrs., vol. 215, Part C. IMechIE 2001.

(56) References Cited

OTHER PUBLICATIONS

Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Bloom, et al., "Modular cast block—The future of coke oven repairs," Iron & Steel Technol, AIST, Warrendale, PA, vol. 4, No. 3, Mar. 1, 2007, pp. 61-64.
Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
Industrial Furnace Design Handbook, Editor-in-Chief: First Design Institute of First Ministry of Machinery Industry, Beijing: Mechanical Industry Press, pp. 180-183, Oct. 1981.
JP 03-197588, Inoue Keizo et al., Method and Equipment For Boring Degassing Hole In Coal Charge In Coke Oven, Japanese Patent (Abstract Only) Aug. 28, 1991.
JP 04-159392, Inoue Keizo et al., Method And Equipment For Opening Hole For Degassing Of Coal Charge In Coke Oven, Japanese Patent (Abstract Only) Jun. 2, 1992.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
Extended European Search Report for European Application No. 15836657.5; dated Feb. 15, 2018; 8 pages.
International Search Report and Written Opinion of International Application No. PCT/US2015/047533; dated Oct. 22, 2015, 17 pages.
Russian Office Action for Russian Application No. 2017110046/05(017702); dated Feb. 19, 2019; 12 pages.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Brazilian Preliminary Examination Report for Brazilian Application No. BR112017004037-9; dated Aug. 27, 2019; 7 pages.
Japanese Notice of Rejectionfor Japanese Application No. 2017-511645; dated Aug. 13, 2019; 5 pages.
U.S. Appl. No. 16/704,689, filed Dec. 5, 2019, West et al.
U.S. Appl. No. 16/729,036, filed Dec. 27, 2019, Quanci et at.
U.S. Appl. No. 16/729,053, filed Dec. 27, 2019, Quanci et at.
U.S. Appl. No. 16/729,057, filed Dec. 27, 2019, Quanci et at.
U.S. Appl. No. 16/729,068, filed Dec. 27, 2019, Quanci et at.
U.S. Appl. No. 16/729,122, filed Dec. 27, 2019, Quanci et at.
U.S. Appl. No. 16/729,129, filed Dec. 27, 2019, Quanci et at.
U.S. Appl. No. 16/729,157, filed Dec. 27, 2019, Quanci et at.
U.S. Appl. No. 16/729,170, filed Dec. 27, 2019, Quanci et at.
U.S. Appl. No. 16/729,201, filed Dec. 27, 2019, Quanci et at.
U.S. Appl. No. 16/729,212, filed Dec. 27, 2019, Quanci et at.
U.S. Appl. No. 16/729,219, filed Dec. 27, 2019, Quanci et at.
U.S. Appl. No. 16/735,103, filed Jan. 6, 2020, Quanci et al.
Joseph, B., "A tutorial on inferential control and its applications," Proceedings of the 1999 American Control Conference (Cat. No. 99CH36251), San Diego, CA, 1999, pp. 3106-3118 vol. 5.
Australian Examination Report No. 1 for Australian Application No. 2015308687; dated Nov. 8, 2019; 3 pages.
Ukraine Office Action for Ukraine Application No. a 2017 02656; dated Jan. 22, 2020; 4 pages.
Vietnam Office Action for Vietnam Application No. 1-2017-01008; dated Jan. 21, 2020; 2 pages.
U.S. Appl. No. 16/000,516, filed Jun. 5, 2018, titled Systems and Methods for Removing Mercury From Emissions.
U.S. Appl. No. 15/322,176, filed Dec. 27, 2016, titled Horizontal Heat Recovery Coke Ovens Having Monolith Crowns.
U.S. Appl. No. 15/392,942, filed Dec. 28, 2016, titled Method and System for Dynamically Charging a Coke Oven.
Examination Report for European Application No. 15836657.5; dated Mar. 13, 2019; 6 pages.
India First Examination Report in Application No. 201737007129; dated Jul. 22, 2019; 7 pages.

| HOUR | UPTAKE POSITION |
|---|---|
| 0 - 1 | 14 (FULLY OPEN) |
| 1 - 5 | 14 |
| 5 - 8 | 14 |
| 8 - 12 | 14 |
| 12 - 18 | 14 |
| 18 - 25 | 12 |
| 25 - 30 | 10 |
| 30 - 35 | 8 |
| 35 - 40 | 6 |
| > 40 | 2 (FULLY CLOSED) |

FIG.9

| CROWN TEMPERATURE (F) | UPTAKE POSITION |
|---|---|
| START OF CYCLE - 2200 | 14 (FULLY OPEN) |
| 2200 - 2300 | 12 |
| 2400 - 2450 | 10 |
| 2500 | 8 |
| 2550 - 2625 | 6 |
| 2650 | 4 |
| 2700 | 2 (FULLY CLOSED) |

FIG.10

| | OVEN | DATE | TONNAGE (METRIC TONS) | COKING TIME (H) | COKING RATE | |
|---|---|---|---|---|---|---|
| OLD PROFILE | 30 | 9/10/14 | 41.26 | 44.28 | 0.93 | |
| | | 11/10/14 | 41.36 | 47.10 | 0.88(1) | |
| | | 13/10/14 | 41.29 | 41.30 | 1.00 | → MAX CROWN TEMP: 1467 C |
| NEW PROFILE | | 15/10/14 | 42.01 | 42.75 | 0.98 | |
| | | 17/10/14 | 41.35 | 44.70 | 0.93 | |
| | | 19/10/14 | 43.08 | 44.83 | 0.96 | |
| | | 21/10/14 | 41.52 | 42.05 | 0.99 | |
| | | 23/10/14 | 42.08 | 57.22 | 0.74(1) | |
| | | 25/10/14 | 43.41 | 41.53 | 1.05 | → MAX CROWN TEMP: 1450 C |
| | | 27/10/14 | 40.09 | 44.52 | 0.90 | |

FIG.13

BURN PROFILES FOR COKE OPERATIONS

CROSS-REFERENCE TO RELATED APPLICATIONS

This application is a divisional application of U.S. patent application Ser. No. 14/839,551, filed on Aug. 28, 2015, which claims the benefit of priority to U.S. Provisional Patent Application No. 62/043,359, filed Aug. 28, 2014, the disclosure of which are incorporated herein by reference in their entirety.

TECHNICAL FIELD

The present technology is generally directed to coke oven burn profiles and methods and systems of optimizing coke plant operation and output.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for twenty-four to forty-eight hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

Coal particles or a blend of coal particles are charged into hot ovens, and the coal is heated in the ovens in order to remove volatile matter (VM) from the resulting coke. Horizontal heat recovery (HHR) ovens operate under negative pressure and are typically constructed of refractory bricks and other materials, creating a substantially airtight environment. The negative pressure ovens draw in air from outside the oven to oxidize the coal's VM and to release the heat of combustion within the oven.

In some arrangements, air is introduced to the oven through damper ports or apertures in the oven sidewall or door. In the crown region above the coal-bed, the air combusts with the VM gases evolving from the pyrolysis of the coal. However, with reference to FIGS. 1-3, the buoyancy effect, acting on the cold air entering the oven chamber, can lead to coal burnout and loss in yield productivity. Specifically, as shown in FIG. 1, the cold, dense air entering the oven falls towards the hot coal surface. Before the air can warm, rise, combust with volatile matter, and/or disperse and mix in the oven, it comes into contact with the surface of the coal bed and combusts, creating "hot spots," as indicated in FIG. 2. With reference to FIG. 3, these hot spots create a burn loss on the coal surface, as evidenced by the depressions formed in the coal bed surface. Accordingly, there exists a need to improve combustion efficiency in coke ovens.

In many coking operations, the draft of the ovens is at least partially controlled through the opening and closing of uptake dampers. However, traditional coking operations base changes to the uptake damper settings on time. For example, in a forty-eight hour cycle, the uptake damper is typically set to be fully open for approximately the first twenty-four hours of the coking cycle. The dampers are then moved to a first partially restricted position prior to thirty-two hours into the coking cycle. Prior to forty hours into the coking cycle, the dampers are moved to a second, further restricted position. At the end of the forty-eight hour coking cycle, the uptake dampers are substantially closed. This manner of managing the uptake dampers can prove to be inflexible. For example, larger charges, exceeding forty-seven tons, can release too much VM into the oven for the volume of air entering the oven through the wide open uptake damper settings. Combustion of this VM-air mixture over prolonged periods of time can cause the temperatures to rise in excess of the NTE temperatures, which can damage the oven. Accordingly, there exists a need to increase the charge weight of coke ovens without exceeding not to exceed (NTE) temperatures.

Heat generated by the coking process is typically converted into power by heat recovery steam generators (HRSGs) associated with the coke plant. Inefficient burn profile management could result in the VM gases not being burned in the oven and sent to the common tunnel. This wastes heat that could be used by the coking oven for the coking process. Improper management of the burn profile can further lower the coke production rate, as well as the quality of the coke produced by a coke plant. For example, many current methods of managing the uptake in coke ovens limits the sole flue temperature ranges that may be maintained over the coking cycle, which can adversely impact production rate and coke quality. Accordingly, there exists a need to improve the manner in which the burn profiles of the coking ovens are managed in order to optimize coke plant operation and output.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

FIG. 9 depicts a traditional uptake operation table, indicating at what position the uptake is to be placed at particular times throughout a forty-eight hour coking cycle.

FIG. 10 depicts an uptake operation table, in accordance with embodiments of the present technology, indicating at what position the uptake is to be placed at particular coke oven crown temperature ranges throughout a forty-eight hour coking cycle.

FIG. 13 depicts a graphical comparison of tonnage, coking time, and coking rate for a traditional burn profile and a burn profile in accordance with embodiments of the present technology.

DETAILED DESCRIPTION

Figure 1:
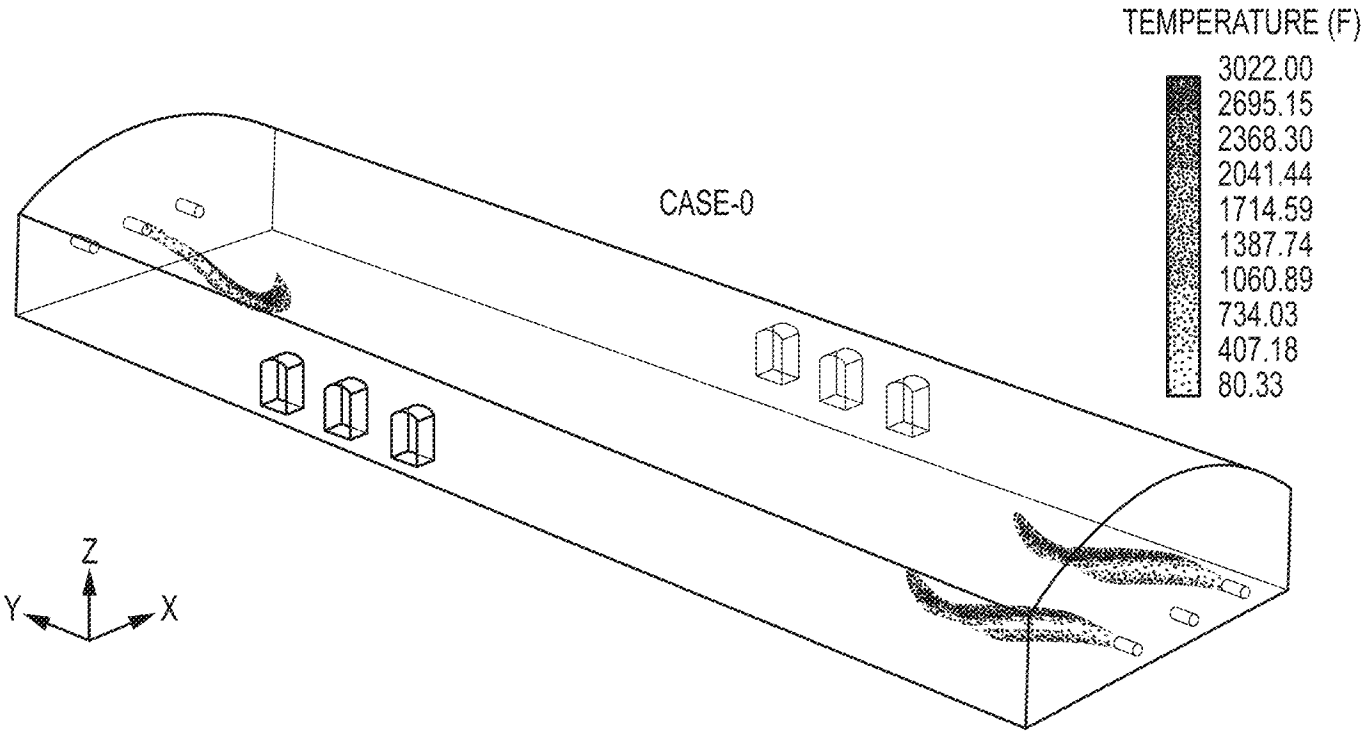
FIG.1 (PRIOR ART)
FIG. 1 depicts an isometric, partially transparent view of a prior art coke oven having door air inlets at opposite ends of the coke oven and depicts one manner in which air enters the oven and sinks toward the coal surface due to buoyant forces.
Figure 2:
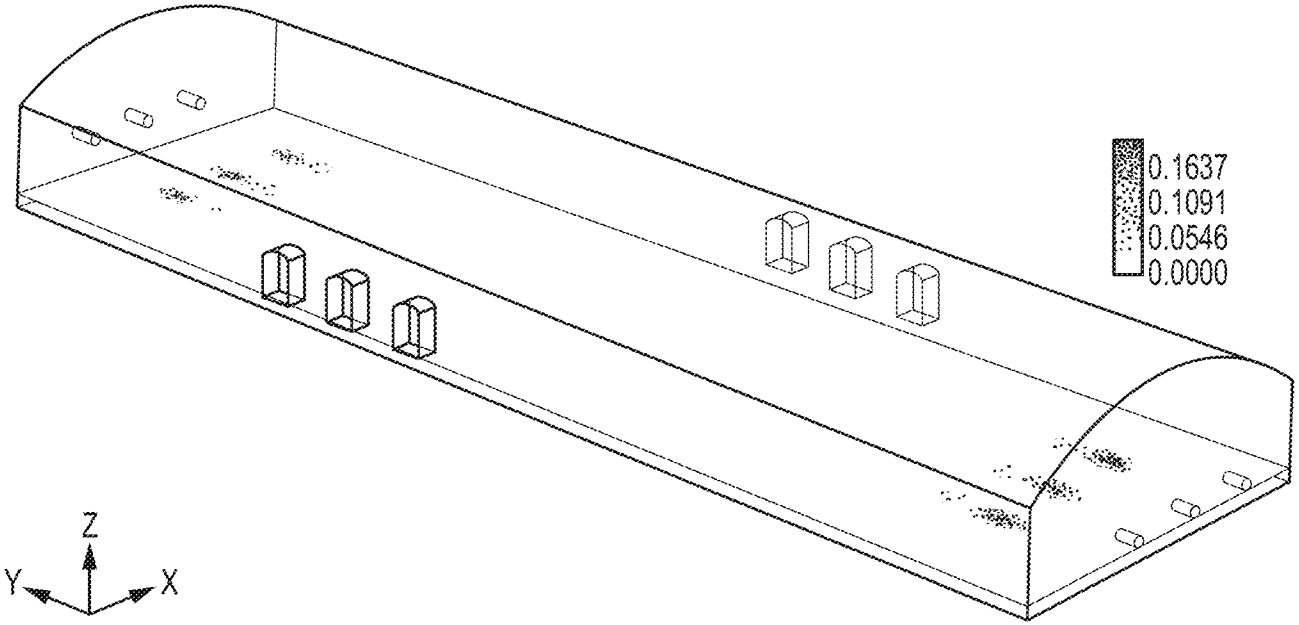
FIG.2 (PRIOR ART)
FIG. 2 depicts an isometric, partially transparent view of a prior art coke oven and areas of coke bed surface burnout formed by direct contact between streams of air and the coal bed surface.

The present technology is generally directed to systems and methods for optimizing the burn profiles for coke ovens, such as horizontal heat recovery (HHR) ovens. In various embodiments, the burn profile is at least partially optimized by controlling air distribution in the coke oven. In some embodiments, the air distribution is controlled according to temperature readings in the coke oven. In particular embodiments, the system monitors the crown temperature of the coke oven. The transfer of gases between the oven crown and the sole flue is optimized to increase sole flue temperatures throughout the coking cycle. In some embodiments, the present technology allows the charge weight of coke ovens to be increased, without exceeding not to exceed (NTE) temperatures, by transferring and burning more of the VM gases in the sole flue. Embodiments of the present technology include an air distribution system having a plurality of crown air inlets positioned above the oven floor. The crown air inlets are configured to introduce air into the oven chamber in a manner that reduces bed burnout.

Specific details of several embodiments of the technology are described below with reference to FIGS. 4-15. Other details describing well-known structures and systems often associated with coking facilities, and in particular air distribution systems, automated control systems, and coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 4-15.

As will be described in further detail below, in several embodiments, the individual coke ovens 100 can include one or more air inlets configured to allow outside air into the negative pressure oven chamber to combust with the coal's VM. The air inlets can be used with or without one or more air distributors to direct, circulate, and/or distribute air within the oven chamber. The term "air", as used herein, can include ambient air, oxygen, oxidizers, nitrogen, nitrous oxide, diluents, combustion gases, air mixtures, oxidizer mixtures, flue gas, recycled vent gas, steam, gases having additives, inerts, heat-absorbers, liquid phase materials such as water droplets, multiphase materials such as liquid droplets atomized via a gaseous carrier, aspirated liquid fuels, atomized liquid heptane in a gaseous carrier stream, fuels such as natural gas or hydrogen, cooled gases, other gases, liquids, or solids, or a combination of these materials. In various embodiments, the air inlets and/or distributors can function (i.e., open, close, modify an air distribution pattern, etc.) in response to manual control or automatic advanced control systems. The air inlets and/or air distributors can operate on a dedicated advanced control system or can be controlled by a broader draft control system that adjusts the air inlets and/or distributors as well as uptake dampers, sole flue dampers, and/or other air distribution pathways within coke oven systems.

Figure 4:
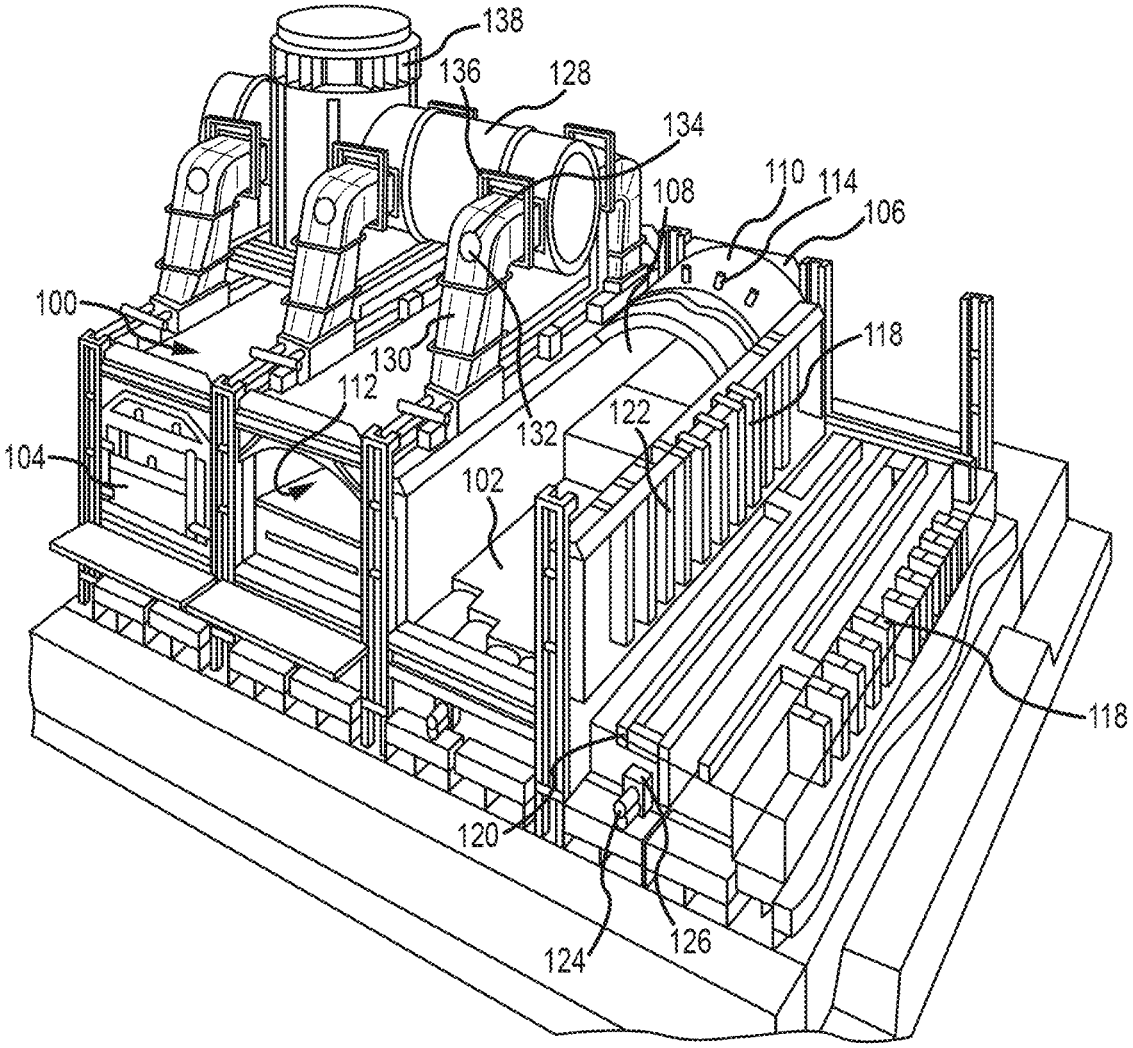
FIG. 4 depicts an isometric, partial cut-away view of a portion of a horizontal heat recovery coke plant configured in accordance with embodiments of the present technology.
Figure 5:
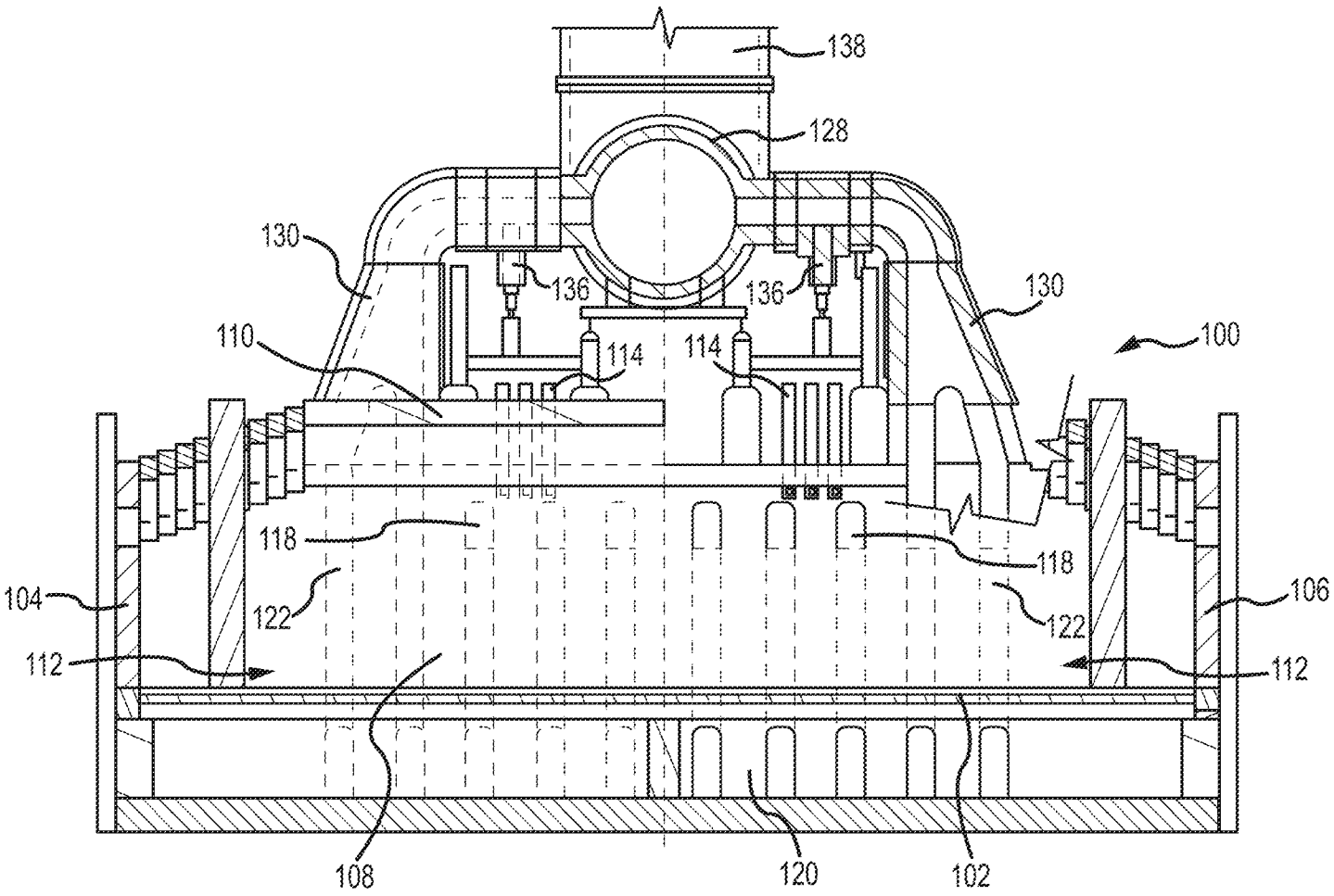
FIG. 5 depicts a sectional view of a horizontal heat recovery coke oven configured in accordance with embodiments of the present technology.

FIG. 4 depicts a partial cut-away view of a portion of an HHR coke plant configured in accordance with embodiments of the present technology. FIG. 5 depicts a sectional view of an HHR coke oven 100 configured in accordance with embodiments of the present technology. Each oven 100 includes an open cavity defined by an oven floor 102, a pusher side oven door 104, a coke side oven door 106 opposite the pusher side oven door 104, opposite sidewalls 108 that extend upwardly from the floor 102 and between the pusher side oven door 104 and coke side oven door 106, and a crown 110, which forms a top surface of the open cavity of an oven chamber 112. Controlling air flow and pressure inside the oven chamber 112 plays a significant role in the efficient operation of the coking cycle. Accordingly, with reference to FIG. 6 and FIG. 7, embodiments of the present technology include one or more crown air inlets 114 that allow primary combustion air into the oven chamber 112. In some embodiments, multiple crown air inlets 114 penetrate the crown 110 in a manner that selectively places oven chamber 112 in open fluid communication with the ambient environment outside the oven 100. With reference to FIG. 8, an example of an uptake elbow air inlet 115 is depicted as having an air damper 116, which can be positioned at any of a number of positions between fully open and fully closed to vary an amount of air flow through the air inlet. Other oven air inlets, including door air inlets and the crown air inlets 114 include air dampers 116 that operate in a similar manner. The uptake elbow air inlet 115 is positioned to allow air into the common tunnel 128, whereas the door air inlets and the crown air inlets 114 vary an amount of air flow into the oven chamber 112. While embodiments of the present technology may use crown air inlets 114, exclusively, to provide primary combustion air into the oven chamber 112, other types of air inlets, such as the door air inlets, may be used in particular embodiments without departing from aspects of the present technology.

In operation, volatile gases emitted from coal positioned inside the oven chamber 112 collect in the crown and are drawn downstream into downcomer channels 118 formed in one or both sidewalls 108. The downcomer channels 118 fluidly connect the oven chamber 112 with a sole flue 120, which is positioned beneath the oven floor 102. The sole flue 120 forms a circuitous path beneath the oven floor 102. Volatile gases emitted from the coal can be combusted in the sole flue 120, thereby, generating heat to support the reduction of coal into coke. The downcomer channels 118 are fluidly connected to uptake channels 122 formed in one or both sidewalls 108. A secondary air inlet 124 can be provided between the sole flue 120 and atmosphere, and the secondary air inlet 124 can include a secondary air damper 126 that can be positioned at any of a number of positions between fully open and fully closed to vary the amount of secondary air flow into the sole flue 120. The uptake channels 122 are fluidly connected to a common tunnel 128 by one or more uptake ducts 130. A tertiary air inlet 132 can be provided between the uptake duct 130 and atmosphere. The tertiary air inlet 132 can include a tertiary air damper 134, which can be positioned at any of a number of positions between fully open and fully closed to vary the amount of tertiary air flow into the uptake duct 130.

Each uptake duct 130 includes an uptake damper 136 that may be used to control gas flow through the uptake ducts 130 and within the ovens 100. The uptake damper 136 can be positioned at any number of positions between fully open and fully closed to vary the amount of oven draft in the oven 100. The uptake damper 136 can comprise any automatic or manually-controlled flow control or orifice blocking device (e.g., any plate, seal, block, etc.). In at least some embodiments, the uptake damper 136 is set at a flow position between 0 and 2, which represents "closed," and 14, which represents "fully open." It is contemplated that even in the "closed" position, the uptake damper 136 may still allow the passage of a small amount of air to pass through the uptake duct 130. Similarly, it is contemplated that a small portion of the uptake damper 136 may be positioned at least partially within a flow of air through the uptake duct 130 when the uptake damper 136 is in the "fully open" position. It will be appreciated that the uptake damper may take a nearly infinite number of positions between 0 and 14. With reference to FIG. 9 and FIG. 10, some exemplary settings for the uptake damper 136, increasing in the amount of flow restriction, include: 12, 10, 8, and 6. In some embodiments, the flow position number simply reflects the use of a fourteen inch uptake duct, and each number represents the amount of the uptake duct 130 that is open, in inches. Otherwise, it will be understood that the flow position number scale of 0-14 can be understood simply as incremental settings between open and closed.

As used herein, "draft" indicates a negative pressure relative to atmosphere. For example a draft of 0.1 inches of water indicates a pressure of 0.1 inches of water below atmospheric pressure. Inches of water is a non-SI unit for pressure and is conventionally used to describe the draft at various locations in a coke plant. In some embodiments, the draft ranges from about 0.12 to about 0.16 inches of water. If a draft is increased or otherwise made larger, the pressure moves further below atmospheric pressure. If a draft is decreased, drops, or is otherwise made smaller or lower, the pressure moves towards atmospheric pressure. By controlling the oven draft with the uptake damper 136, the air flow into the oven 100 from the crown air inlets 114, as well as air leaks into the oven 100, can be controlled. Typically, as shown in FIG. 5, an individual oven 100 includes two uptake ducts 130 and two uptake dampers 136, but the use of two uptake ducts and two uptake dampers is not a necessity; a system can be designed to use just one or more than two uptake ducts and two uptake dampers.

In operation, coke is produced in the ovens 100 by first charging coal into the oven chamber 112, heating the coal in an oxygen depleted environment, driving off the volatile fraction of coal and then oxidizing the VM within the oven 100 to capture and use the heat given off. The coal volatiles are oxidized within the oven 100 over an extended coking cycle and release heat to regeneratively drive the carbonization of the coal to coke. The coking cycle begins when the pusher side oven door 104 is opened and coal is charged onto the oven floor 102 in a manner that defines a coal bed. Heat from the oven (due to the previous coking cycle) starts the carbonization cycle. In many embodiments, no additional fuel other than that produced by the coking process is used. Roughly half of the total heat transfer to the coal bed is radiated down onto the top surface of the coal bed from the luminous flame of the coal bed and the radiant oven crown 110. The remaining half of the heat is transferred to the coal bed by conduction from the oven floor 102 which is convectively heated from the volatilization of gases in the sole flue 120. In this way, a carbonization process "wave" of plastic flow of the coal particles and formation of high strength cohesive coke proceeds from both the top and bottom boundaries of the coal bed.

Typically, each oven 100 is operated at negative pressure so air is drawn into the oven during the reduction process due to the pressure differential between the oven 100 and atmosphere. Primary air for combustion is added to the oven chamber 112 to partially oxidize the coal volatiles, but the amount of this primary air is controlled so that only a portion of the volatiles released from the coal are combusted in the oven chamber 112, thereby, releasing only a fraction of their enthalpy of combustion within the oven chamber 112. In various embodiments, the primary air is introduced into the oven chamber 112 above the coal bed through the crown air inlets 114, with the amount of primary air controlled by the crown air dampers 116. In other embodiments, different types of air inlets may be used without departing from aspects of the present technology. For example, primary air may be introduced to the oven through air inlets, damper ports, and/or apertures in the oven sidewalls or doors. Regardless of the type of air inlet used, the air inlets can be used to maintain the desired operating temperature inside the oven chamber 112. Increasing or decreasing primary air flow into the oven chamber 112 through the use of air inlet dampers will increase or decrease VM combustion in the oven chamber 112 and, hence, temperature.

Figure 6:
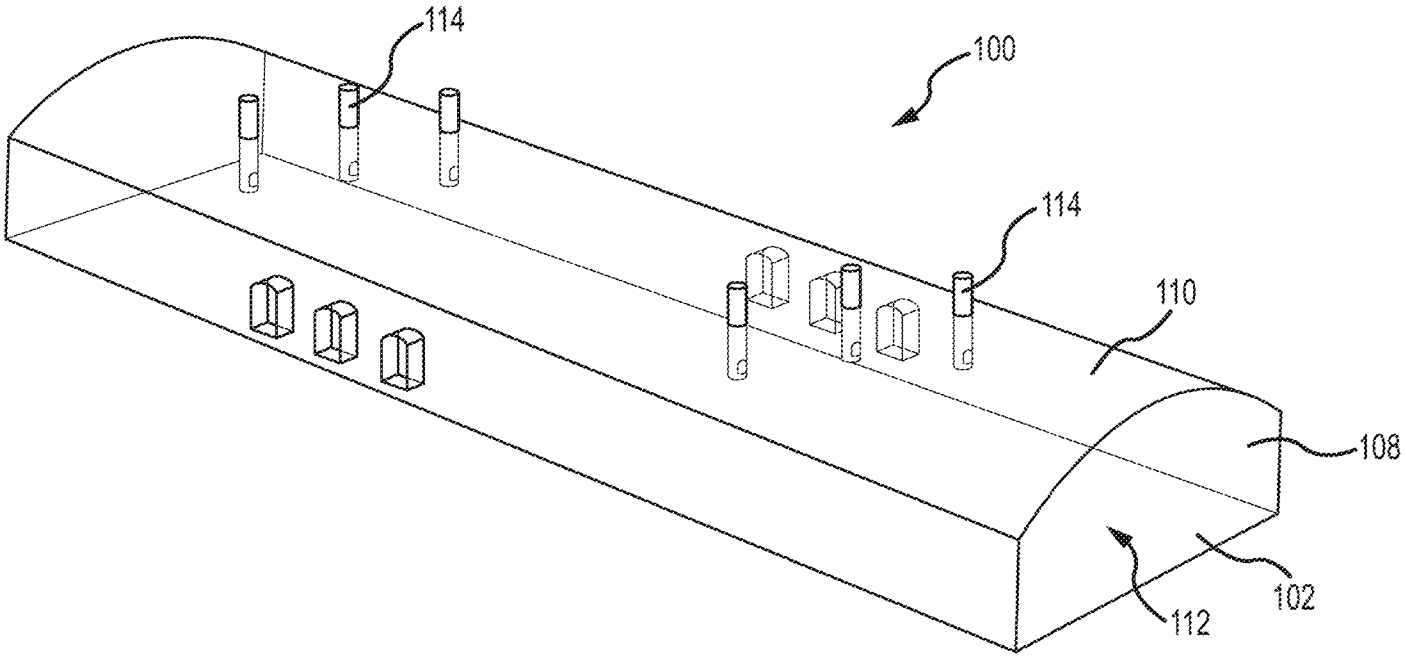
FIG. 6 depicts an isometric, partially transparent view of a coke oven having crown air inlets configured in accordance with embodiments of the present technology.
Figure 7:
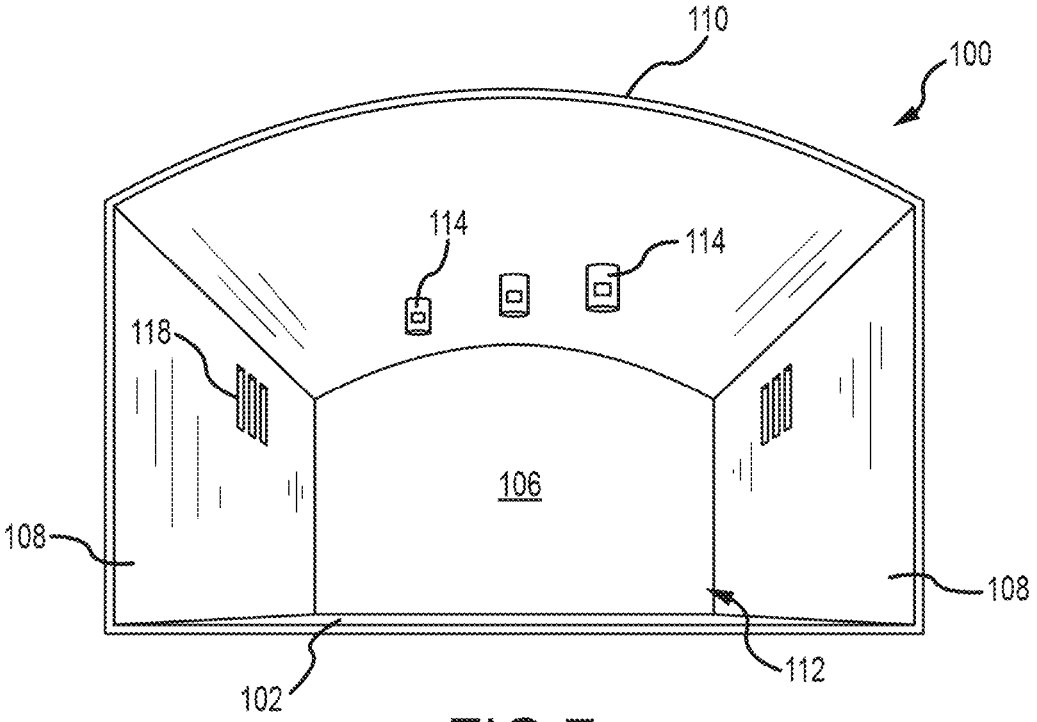
FIG. 7 depicts a partial end view of the coke oven depicted in FIG. 6.
Figure 8:
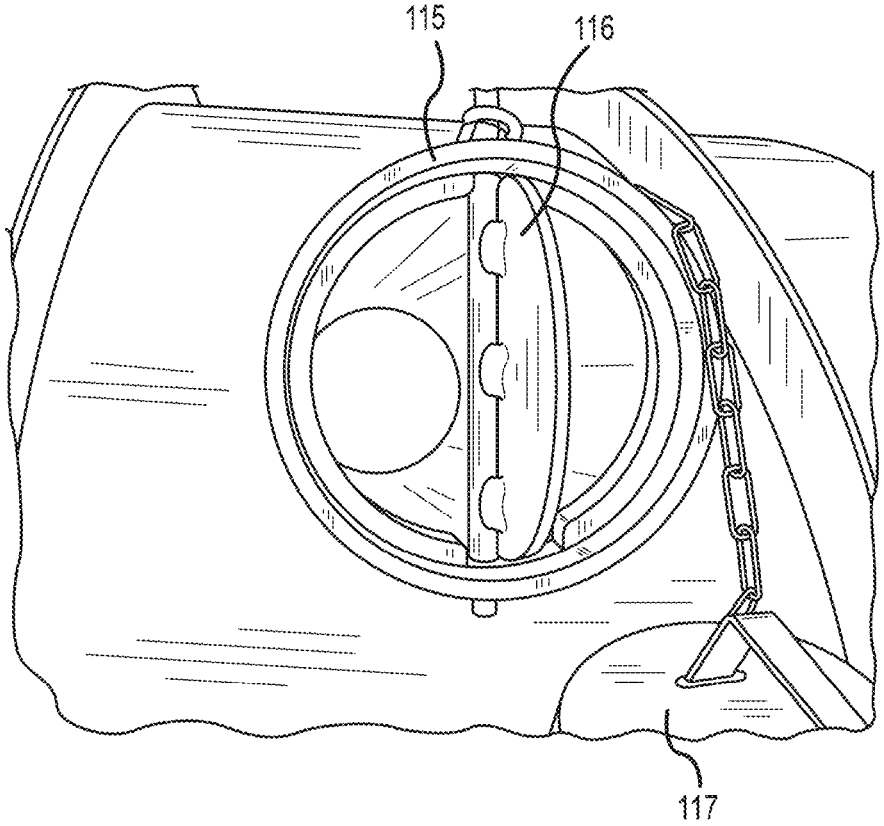
FIG. 8 depicts a top, plan view of an air inlet configured in accordance with embodiments of the present technology.

With reference to FIGS. 6 and 7, a coke oven 100 may be provided with crown air inlets 114 configured, in accordance with embodiments of the present technology, to introduce combustion air through the crown 110 and into the oven chamber 112. In one embodiment, three crown air inlets 114 are positioned between the pusher side oven door 104 and a mid-point of the oven 100, along an oven length. Similarly, three crown air inlets 114 are positioned between the coke side oven door 106 and the mid-point of the oven 100. It is contemplated, however, that one or more crown air inlets 114 may be disposed through the oven crown 110 at various locations along the oven's length. The chosen number and positioning of the crown air inlets depends, at least in part, on the configuration and use of the oven 100. Each crown air inlet 114 can include an air damper 116, which can be positioned at any of a number of positions between fully open and fully closed, to vary the amount of air flow into the oven chamber 112. In some embodiments, the air damper 116 may, in the "fully closed" position, still allow the passage of a small amount of ambient air to pass through the crown air inlet 114 into the oven chamber. Accordingly, with reference to FIG. 8, various embodiments of the crown air inlets 114, uptake elbow air inlet 115, or door air inlet, may include a cap 117 that may be removably secured to an open upper end portion of the particular air inlet. The cap 117 may substantially prevent weather (such as rain and snow), additional ambient air, and other foreign matter from passing through the air inlet. It is contemplated that the coke oven 100 may further include one or more distributors configured to channel/distribute air flow into the oven chamber 112.

Figure 3:
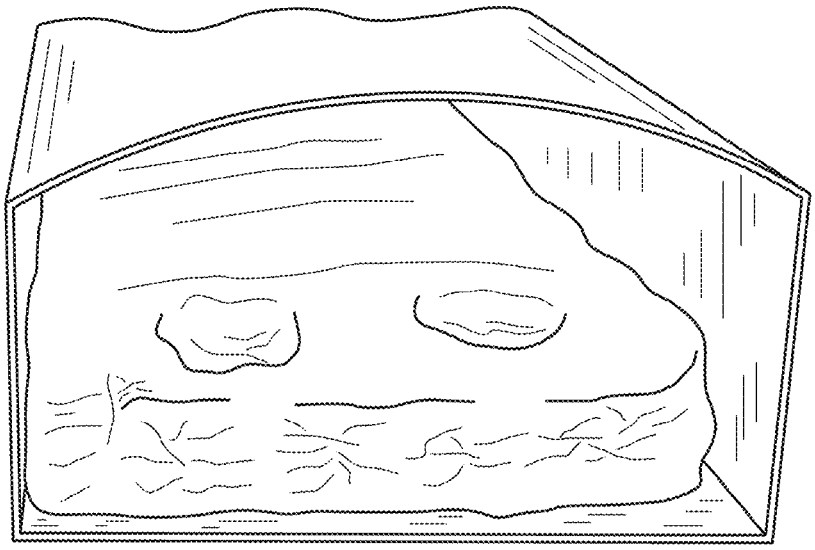
FIG.3 (PRIOR ART)
FIG. 3 depicts a partial end elevation view of a coke oven and depicts examples of dimples that form on a coke bed surface due to direct contact between a stream of air and the surface of the coal bed.
Figure 11:
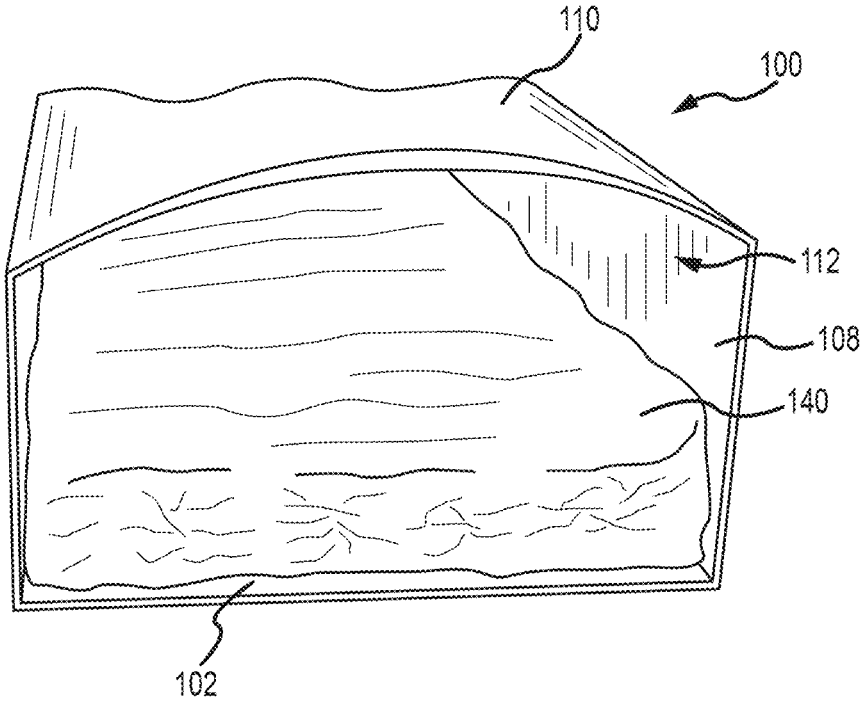
FIG. 11 depicts a partial end view of a coke oven containing a coke bed produced in accordance with embodiments of the present technology.

In various embodiments, the crown air inlets 114 are operated to introduce ambient air into the oven chamber 112 over the course of the coking cycle much in the way that other air inlets, such as those typically located within the oven doors, are operated. However, use of the crown air inlets 114 provides a more uniform distribution of air throughout the oven crown, which has shown to provide better combustion, higher temperatures in the sole flue 120 and later cross over times. The uniform distribution of the air in the crown 110 of the oven 110 reduces the likelihood that the air will contact the surface of the coal bed and create hot spots that create burn losses on the coal surface, as depicted in FIG. 3. Rather, the crown air inlets 114 substantially reduce the occurrence of such hot spots, creating a uniform coal bed surface 140 as it cokes, such as depicted in FIG. 11. In particular embodiments of use, the air dampers 116 of each of the crown air inlets 114 are set at similar positions with respect to one another. Accordingly, where one air damper 116 is fully open, all of the air dampers 116 should be placed in the fully open position and if one air damper 116 is set at a half open position, all of the air dampers 116 should be set at half open positions. However, in particular embodiments, the air dampers 116 could be changed independently from one another. In various embodiments, the air dampers 116 of the crown air inlets 114 are opened up quickly after the oven 100 is charged or right before the oven 100 is charged. A first adjustment of the air dampers 116 to a ¾ open position is made at a time when a first door hole burning would typically occur. A second adjustment of the air dampers 116 to a ½ open position is made at a time when a second door hole burning would occur. Additional adjustments are made based on operating conditions detected throughout the coke oven 100.

The partially combusted gases pass from the oven chamber 112 through the downcomer channels 118 into the sole flue 120 where secondary air is added to the partially combusted gases. The secondary air is introduced through the secondary air inlet 124. The amount of secondary air that is introduced is controlled by the secondary air damper 126. As the secondary air is introduced, the partially combusted gases are more fully combusted in the sole flue 120, thereby, extracting the remaining enthalpy of combustion which is conveyed through the oven floor 102 to add heat to the oven chamber 112. The fully or nearly-fully combusted exhaust gases exit the sole flue 120 through the uptake channels 122 and then flow into the uptake duct 130. Tertiary air is added to the exhaust gases via the tertiary air inlet 132, where the amount of tertiary air introduced is controlled by the tertiary air damper 134 so that any remaining fraction of non-combusted gases in the exhaust gases are oxidized downstream of the tertiary air inlet 132. At the end of the coking cycle, the coal has coked out and has carbonized to produce coke. The coke is preferably removed from the oven 100 through the coke side oven door 106 utilizing a mechanical extraction system, such as a pusher ram. Finally, the coke is quenched (e.g., wet or dry quenched) and sized before delivery to a user.

As discussed above, control of the draft in the ovens 100 can be implemented by automated or advanced control systems. An advanced draft control system, for example, can automatically control an uptake damper 136 that can be positioned at any one of a number of positions between fully open and fully closed to vary the amount of oven draft in the oven 100. The automatic uptake damper can be controlled in response to operating conditions (e.g., pressure or draft, temperature, oxygen concentration, gas flow rate, downstream levels of hydrocarbons, water, hydrogen, carbon dioxide, or water to carbon dioxide ratio, etc.) detected by at least one sensor. The automatic control system can include one or more sensors relevant to the operating conditions of the coke plant. In some embodiments, an oven draft sensor or oven pressure sensor detects a pressure that is indicative of the oven draft. With reference to FIGS. 4 and 5 together, the oven draft sensor can be located in the oven crown 110 or elsewhere in the oven chamber 112. Alternatively, an oven draft sensor can be located at either of the automatic uptake dampers 136, in the sole flue 120, at either the pusher side oven door 104 or coke side oven door 106, or in the common tunnel 128 near or above the coke oven 100. In one embodiment, the oven draft sensor is located in the top of the oven crown 110. The oven draft sensor can be located flush with the refractory brick lining of the oven crown 110 or could extend into the oven chamber 112 from the oven crown 110. A bypass exhaust stack draft sensor can detect a pressure that is indicative of the draft at the bypass exhaust stack 138 (e.g., at the base of the bypass exhaust stack 138). In some embodiments, a bypass exhaust stack draft sensor is located at the intersection of the common tunnel 128 and a crossover duct. Additional draft sensors can be positioned at other locations in the coke plant 100. For example, a draft sensor in the common tunnel could be used to detect a common tunnel draft indicative of the oven draft in multiple ovens proximate the draft sensor. An intersection draft sensor can detect a pressure that is indicative of the draft at one of the intersections of the common tunnel 128 and one or more crossover ducts.

An oven temperature sensor can detect the oven temperature and can be located in the oven crown 110 or elsewhere in the oven chamber 112. A sole flue temperature sensor can detect the sole flue temperature and is located in the sole flue 120. A common tunnel temperature sensor detects the common tunnel temperature and is located in the common tunnel 128. Additional temperature or pressure sensors can be positioned at other locations in the coke plant 100.

An uptake duct oxygen sensor is positioned to detect the oxygen concentration of the exhaust gases in the uptake duct 130. An HRSG inlet oxygen sensor can be positioned to detect the oxygen concentration of the exhaust gases at the inlet of a HRSG downstream from the common tunnel 128. A main stack oxygen sensor can be positioned to detect the oxygen concentration of the exhaust gases in a main stack and additional oxygen sensors can be positioned at other locations in the coke plant 100 to provide information on the relative oxygen concentration at various locations in the system.

A flow sensor can detect the gas flow rate of the exhaust gases. Flow sensors can be positioned at other locations in the coke plant to provide information on the gas flow rate at various locations in the system. Additionally, one or more draft or pressure sensors, temperature sensors, oxygen sensors, flow sensors, hydrocarbon sensors, and/or other sensors may be used at the air quality control system 130 or other locations downstream of the common tunnel 128. In some embodiments, several sensors or automatic systems are linked to optimize overall coke production and quality and maximize yield. For example, in some systems, one or more of a crown air inlet 114, a crown inlet air damper 116, a sole flue damper (secondary damper 126), and/or an oven uptake damper 136 can all be linked (e.g., in communication with a common controller) and set in their respective positions collectively. In this way, the crown air inlets 114 can be used to adjust the draft as needed to control the amount of air in the oven chamber 112. In further embodiments, other system components can be operated in a complementary manner, or components can be controlled independently.

An actuator can be configured to open and close the various dampers (e.g., uptake dampers 136 or crown air dampers 116). For example, an actuator can be a linear actuator or a rotational actuator. The actuator can allow the dampers to be infinitely controlled between the fully open and the fully closed positions. In some embodiments, different dampers can be opened or closed to different degrees. The actuator can move the dampers amongst these positions in response to the operating condition or operating conditions detected by the sensor or sensors included in an automatic draft control system. The actuator can position the uptake damper 136 based on position instructions received from a controller. The position instructions can be generated in response to the draft, temperature, oxygen concentration, downstream hydrocarbon level, or gas flow rate detected by one or more of the sensors discussed above; control algorithms that include one or more sensor inputs; a pre-set schedule, or other control algorithms. The controller can be a discrete controller associated with a single automatic damper or multiple automatic dampers, a centralized controller (e.g., a distributed control system or a programmable logic control system), or a combination of the two. Accordingly, individual crown air inlets 114 or crown air dampers 116 can be operated individually or in conjunction with other inlets 114 or dampers 116.

The automatic draft control system can, for example, control an automatic uptake damper 136 or crown air inlet damper 116 in response to the oven draft detected by an oven draft sensor. The oven draft sensor can detect the oven draft and output a signal indicative of the oven draft to a controller. The controller can generate a position instruction in response to this sensor input and the actuator can move the uptake damper 136 or crown air inlet damper 116 to the position required by the position instruction. In this way, an automatic control system can be used to maintain a targeted oven draft. Similarly, an automatic draft control system can control automatic uptake dampers, inlet dampers, the HRSG dampers, and/or a draft fan, as needed, to maintain targeted drafts at other locations within the coke plant (e.g., a targeted intersection draft or a targeted common tunnel draft). The automatic draft control system can be placed into a manual mode to allow for manual adjustment of the automatic uptake dampers, the HRSG dampers, and/or the draft fan, as needed. In still further embodiments, an automatic actuator can be used in combination with a manual control to fully open or fully close a flow path. As mentioned above, the crown air inlets 114 can be positioned in various locations on the oven 100 and can, likewise, utilize an advanced control system in this same manner.

With reference to FIG. 9, previously known coking procedures dictate that the uptake damper 136 is adjusted, over the course of a forty-eight hour coking cycle, based on predetermined points in time throughout the coking cycle. This methodology is referred to herein as the "Old Profile," which is not limited to the exemplary embodiments identified. Rather, the Old Profile simply refers to the practice of uptake damper adjustments, over the course of a coking cycle, based on predetermined points in time. As depicted, it is common practice to begin the coking cycle with the uptake draft 136 in a fully open position (position 14). The uptake draft 136 remains in this position for at least the first twelve to eighteen hours. In some cases, the uptake damper 136 is left fully open for the first twenty-four hours. The uptake damper 136 is typically adjusted to a first partially restricted position (position 12) at eighteen to twenty-five hours into the coking cycle. Next, the uptake damper 136 is adjusted to a second partially restricted position (position 10) at twenty-five to thirty hours into the coking cycle. From thirty to thirty-five hours the uptake damper is adjusted to a third partially restricted position (position 8). The uptake damper is next adjusted to a fourth restricted position (position 6) at thirty-five to forty hours into the coking cycle. Finally, the uptake damper is moved to the fully closed position from forty hours into the coking cycle until the coking process is complete.

In various embodiments of the present technology, the burn profile of the coke oven 100 is optimized by adjusting the uptake damper position according to the crown temperature of the coke oven 100. This methodology is referred to herein as the "New Profile," which is not limited to the exemplary embodiments identified. Rather, the New Profile simply refers to the practice of uptake damper adjustments, over the course of a coking cycle, based on predetermined oven crown temperatures. With reference to FIG. 10, a forty-eight hour coking cycle begins, at an oven crown temperature of approximately 2200° F., with the uptake draft 136 in a fully open position (position 14). In some embodiments, the uptake draft 136 remains in this position until the oven crown reaches a temperature of 2200° F. to 2300° F. At this temperature, the uptake damper 136 is adjusted to a first partially restricted position (position 12). In particular embodiments, the uptake damper 136 is then adjusted to a second partially restricted position (position 10) at an oven crown temperature of between 2400° F. to 2450° F. In some embodiments, the uptake damper 136 is adjusted to a third partially restricted position (position 8) when the oven crown temperature reaches 2500° F. The uptake damper 136 is next adjusted to a fourth restricted position (position 6) at an oven crown temperature of 2550° F. to 2625° F. At an oven crown temperature of 2650° F., in particular embodiments, the uptake damper 136 is adjusted to a fourth partially restricted position (position 4). Finally, the uptake damper 136 is moved to the fully closed position at an oven crown temperature of approximately 2700° F. until the coking process is complete.

Figure 12:
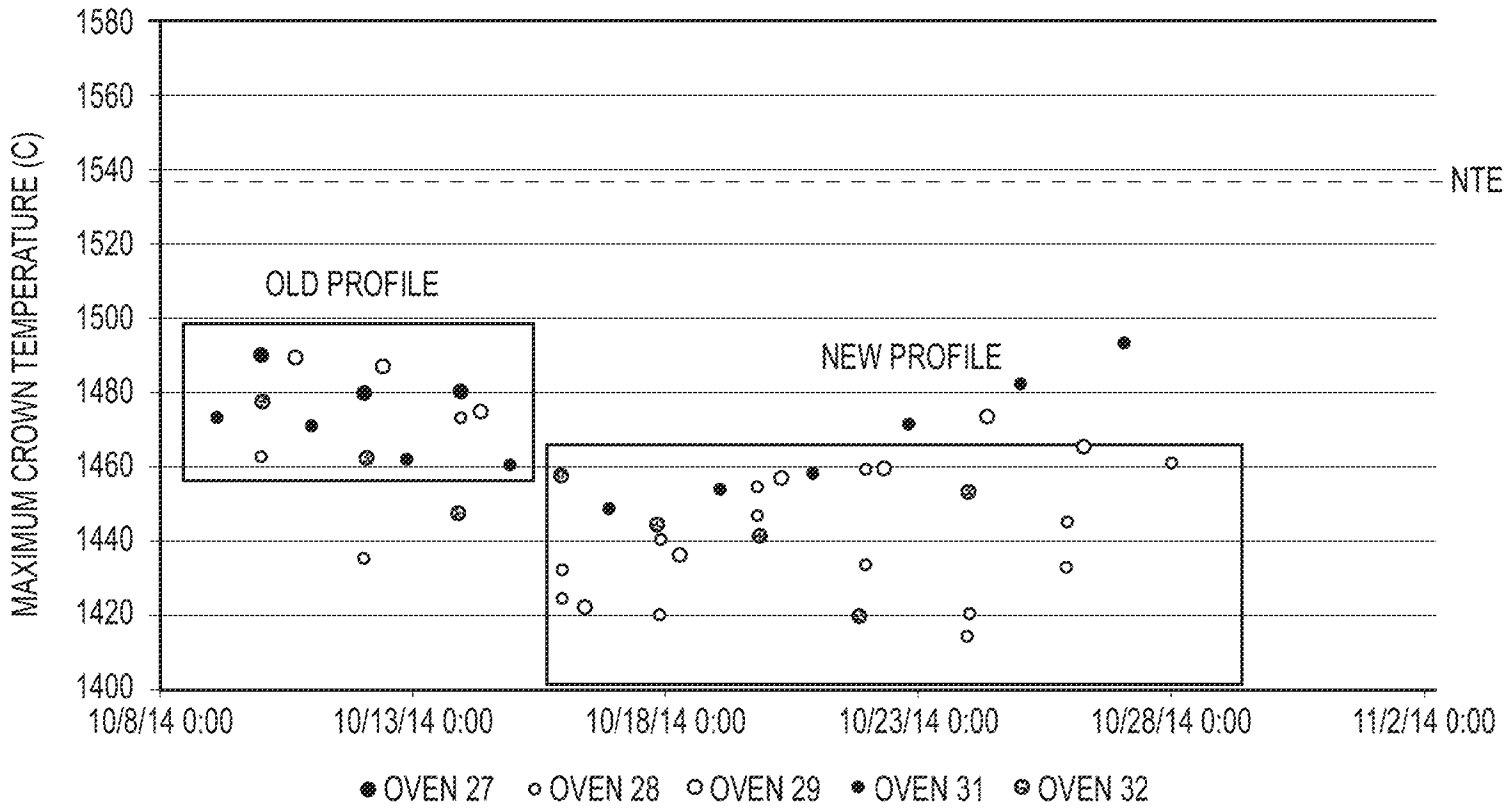
FIG. 12 depicts a graphical comparison of coke oven crown temperatures over time for a traditional burn profile and a burn profile in accordance with embodiments of the present technology.

Correlating the uptake damper 136 position with the oven crown temperature, rather than making adjustments based on predetermined time periods, allows closing the uptake damper 136 earlier in the coking cycle. This lowers the VM release rate and reduces oxygen intake, which lessens the maximum oven crown temperature. With reference to FIG. 12, the Old Profile is generally characterized by relatively high oven crown maximum temperatures of between 1460° C. (2660° F.) and 1490° C. (2714° F.). The New Profile exhibited oven crown maximum temperatures of between 1420° C. (2588° F.) and 1465° C. (2669° F.). This decrease in oven crown maximum temperature decreases the probability of the ovens reaching or exceeding NTE levels that could damage the ovens. This increased control over the oven crown temperature allows for greater coal charges in the oven, which provides for a coal processing rate that is greater than a designed coal processing rate for the coking oven. The decrease in oven crown maximum temperature further allows for increased sole flue temperatures throughout the coking cycle, which improves coke quality and the ability to coke larger coal charges over a standard coking cycle. With reference to FIG. 13, testing has demonstrated that the Old Profile coked a charge of 45.51 tons in 41.3 hours, producing an oven crown maximum temperature of approximately 1467° C. (2672° F.). The New Profile, by comparison, coked a charge of 47.85 tons in 41.53 hours, producing an oven crown maximum temperature of approximately 1450° C. (2642° F.). Accordingly, the New Profile has demonstrated the ability to coke larger charges at a reduced oven crown maximum temperature.

Figure 14:
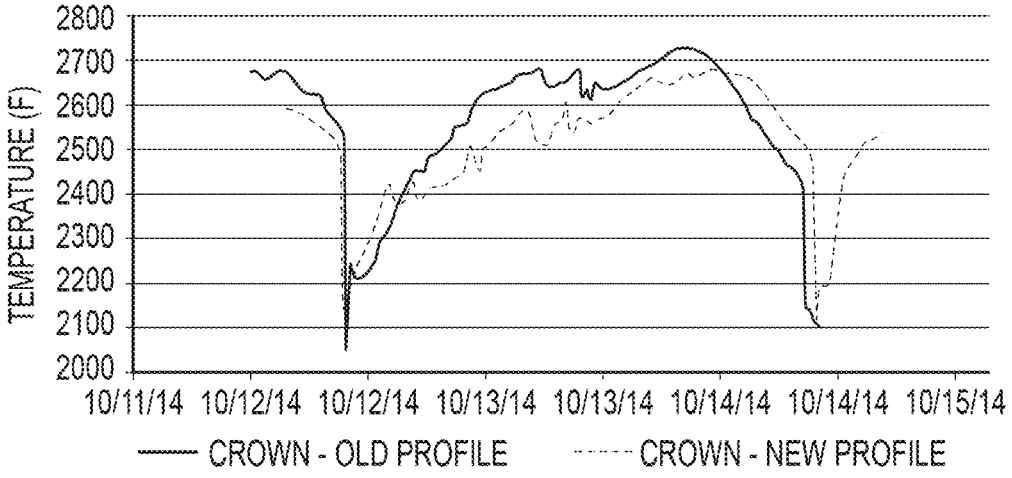
FIG. 14 depicts a graphical comparison of coke oven crown temperatures over time for a traditional burn profile and a burn profile in accordance with embodiments of the present technology.
Figure 15:
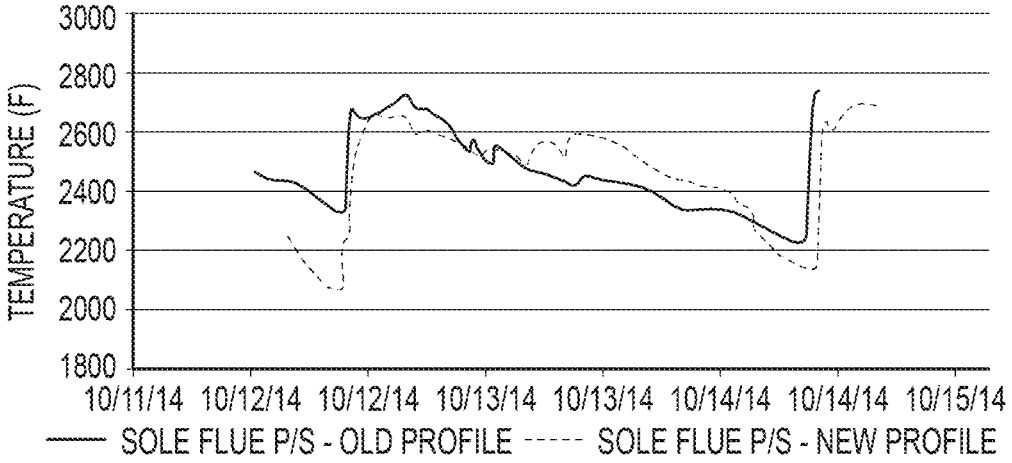
FIG. 15 depicts another graphical comparison of coke oven sole flue temperatures over time for a traditional burn profile and a burn profile in accordance with embodiments of the present technology.

FIG. 14 depicts testing data that compares coke oven crown temperatures over a coking cycle for the Old Profile and the New Profile. In particular, the New Profile demonstrated lower oven crown temperatures and lower peak temperatures. FIG. 15 depicts additional testing data that demonstrates that the New Profile exhibits higher sole flue temperatures for longer periods throughout the coking cycle. The New Profile achieves the lower oven crown temperatures and higher sole flue temperatures, in part, because more VM is drawn into the sole flue and combusted, which increases the sole flue temperatures over the coking cycle. The increased sole flue temperatures produced by the New Profile further benefit coke production rate and coke quality.

Embodiments of the present technology that increase the sole flue temperatures are characterized by higher thermal energy storage in the structures associated with the coke oven 100. The increase in thermal energy storage benefits subsequent coking cycles by shortening their effective coking times. In particular embodiments the coking times are reduced due to higher levels of initial heat absorption by the oven floor 102. The duration of the coking time is assumed to be the amount of time required for the minimum temperature of the coal bed to reach approximately 1860° F. Crown and sole flue temperature profiles have been controlled in various embodiments by adjusting the uptake dampers 136 (e.g. to allow for different levels of draft and air) and the quantity of the air flow in the oven chamber 112. Higher heat in the sole flue 120 at the end of the coking cycle results in the absorption of more energy in the coke oven structures, such as the oven floor 102, which can be a significant factor in accelerating the coking process of the following coking cycle. This not only reduces the coking time but the additional preheat can potentially help avoid clinker buildup in the following coking cycle.

In various burn profile optimization embodiments of the present technology coking cycle in the coking oven 100 starts with an average sole flue temperature that is higher than an average designed sole flue temperature for the coking oven. In some embodiments, this is attained by closing off the uptake dampers earlier in the coking cycle. This leads to a higher initial temperature for the next coking cycle, which permits the release of additional VM. In typical coking operations the additional VM would lead to an NTE temperature in the crown of the coking oven 100. However, embodiments of the present technology provide for shifting the extra VM into the next oven, via gas sharing, or into the sole flue 120, which allows for a higher sole flue temperature. Such embodiments are characterized by a ratcheting up of the sole flue and oven crown average coking cycle temperatures while keeping below any instantaneous NTE temperatures. This is done, at least in part, by shifting and using the excess VM in cooler parts of the oven. For example, an excess of VM at the start of the coking cycle may be shifted into the sole flue 120 to make it hotter. If the sole flue temperatures approach an NTE, the system can shift the VM into the next oven, by gas haring, or into the common tunnel 128. In other embodiments where the volume of VM expires (typically around mid-cycle), the uptakes may be closed to minimize air in-leaks that would cool off the coke oven 100. This leads to a higher temperature at the end of the coking cycle, which leads to a higher average temperature for the next cycle. This allows the system to coke out at a higher rate, which allows for the use of higher coal charges.

EXAMPLES

The following Examples are illustrative of several embodiments of the present technology.

1. A method of controlling a horizontal heat recovery coke oven burn profile, the method comprising:

charging a bed of coal into an oven chamber of a horizontal heat recovery coke oven; the oven chamber being at least partially defined by an oven floor, opposing oven doors, opposing sidewalls that extend upwardly from the oven floor between the opposing oven doors, and an oven crown positioned above the oven floor;

creating a negative pressure draft on the oven chamber so that air is drawn into the oven chamber through at least one air inlet, positioned to place the oven chamber in fluid communication with an environment exterior to the horizontal heat recovery coke oven;

initiating a carbonization cycle of the bed of coal such that volatile matter is released from the coal bed, mixes with the air, and at least partially combusts within the oven chamber, generating heat within the oven chamber;

the negative pressure draft drawing volatile matter into at least one sole flue, beneath the oven floor; at least a portion of the volatile matter combusting within the sole flue, generating heat within the sole flue that is at least partially transferred through the oven floor to the bed of coal;

the negative pressure draft drawing exhaust gases away from the at least one sole flue;

detecting a plurality of temperature changes in the oven chamber over the carbonization cycle;

reducing the negative pressure draft over a plurality of separate flow reducing steps, based on the plurality of temperature changes in the oven chamber.

2. The method of claim 1 wherein the negative pressure draft draws exhaust gases from the at least one sole flue through at least one uptake channel having an uptake damper; the uptake damper being selectively movable between open and closed positions.

3. The method of claim 2 wherein the negative pressure draft is reduced over a plurality of flow reducing steps by moving the uptake damper through a plurality of increasingly flow restrictive positions over the carbonization cycle, based on the plurality of different temperatures in the oven chamber.

4. The method of claim 1 wherein one of the plurality of flow restrictive positions occurs when a temperature of approximately 2200° F.-2300° F. is detected.

5. The method of claim 1 wherein one of the plurality of flow restrictive positions occurs when a temperature of approximately 2400° F.-2450° F. is detected.

6. The method of claim 1 wherein one of the plurality of flow restrictive positions occurs when a temperature of approximately 2500° F. is detected.

7. The method of claim 1 wherein one of the plurality of flow restrictive positions occurs when a temperature of approximately 2550° F. to 2625° F. is detected.

8. The method of claim 1 wherein one of the plurality of flow restrictive positions occurs when a temperature of approximately 2650° F. is detected.

9. The method of claim 1 wherein one of the plurality of flow restrictive positions occurs when a temperature of approximately 2700° F. is detected.

10. The method of claim 1 wherein:

one of the plurality of flow restrictive positions occurring when a temperature of approximately 2200° F. to 2300° F. is detected;

another of the plurality of flow restrictive positions occurring when a temperature of approximately 2400° F. to 2450° F. is detected;

another of the plurality of flow restrictive positions occurring when a temperature of approximately 2500° F. is detected;

another of the plurality of flow restrictive positions occurring when a temperature of approximately 2550° F. to 2625° F. is detected;

another of the plurality of flow restrictive positions occurring when a temperature of approximately 2650° F. is detected; and another of the plurality of flow restrictive positions occurring when a temperature of approximately 2700° F. is detected.

11. The method of claim 1 wherein the at least one air inlet includes at least one crown air inlet positioned in the oven crown above the oven floor.

12. The method of claim 11 wherein the at least one crown air inlet includes an air damper that is selectively movable between open and closed positions to vary a level of fluid flow restriction through the at least one crown air inlet.

13. The method of claim 1 wherein the bed of coal has a weight that exceeds a designed bed charge weight for the horizontal heat recovery coke oven; the oven chamber reaching a maximum crown temperature that is less than a designed not to exceed maximum crown temperature for the horizontal heat recovery coke oven.

14. The method of claim 13 wherein the bed of coal has a weight that is greater than a designed coal charge weight for the coke oven.

15. The method of claim 1 further comprising:

increasing a temperature of the at least one sole flue above a designed sole flue operating temperature for the horizontal heat recovery coke oven by reducing the negative pressure draft over a plurality of separate flow reducing steps, based on the plurality of temperature changes in the oven chamber.

16. A system for controlling a horizontal heat recovery coke oven burn profile, the method comprising:

a horizontal heat recovery coke oven having an oven chamber being at least partially defined by an oven floor, opposing oven doors, opposing sidewalls that extend upwardly from the oven floor between the opposing oven doors, an oven crown positioned above the oven floor, and at least one sole flue, beneath the oven floor, in fluid communication with the oven chamber;

a temperature sensor disposed within the oven chamber;

at least one air inlet, positioned to place the oven chamber in fluid communication with an environment exterior to the horizontal heat recovery coke oven;

at least one uptake channel having an uptake damper in fluid communication with the at least one sole flue; the uptake damper being selectively movable between open and closed positions;

the negative pressure draft is reduced over a plurality of flow reducing steps by; and a controller operatively coupled with the uptake damper and adapted to move the uptake damper through a plurality of increasingly flow restrictive positions over the carbonization cycle, based on the plurality of different temperatures detected by the temperature sensor in the oven chamber.

17. The system of claim 16 wherein the at least one air inlet includes at least one crown air inlet positioned in the oven crown above the oven floor.

18. The system of claim 16 wherein the at least one crown air inlet includes an air damper that is selectively movable between open and closed positions to vary a level of fluid flow restriction through the at least one crown air inlet.

19. The system of claim 16 wherein the controller is further operative to increase a temperature of the at least one sole flue above a designed sole flue operating temperature for the horizontal heat recovery coke oven by moving the uptake damper in a manner that reduces the negative pressure draft over a plurality of separate flow reducing steps, based on the plurality of temperature changes in the oven chamber.

20. The system of claim 16 wherein:

one of the plurality of flow restrictive positions occurring when a temperature of approximately 2200° F. to 2300° F. is detected;

another of the plurality of flow restrictive positions occurring when a temperature of approximately 2400° F. to 2450° F. is detected;

another of the plurality of flow restrictive positions occurring when a temperature of approximately 2500° F. is detected;

another of the plurality of flow restrictive positions occurring when a temperature of approximately 2550° F. to 2625° F. is detected;

another of the plurality of flow restrictive positions occurring when a temperature of approximately 2650° F. is detected; and another of the plurality of flow restrictive positions occurring when a temperature of approximately 2700° F. is detected.

21. A method of controlling a horizontal heat recovery coke oven burn profile, the method comprising:

initiating a carbonization cycle of a bed of coal within an oven chamber of a horizontal heat recovery coke oven;

detecting a plurality of temperature changes in the oven chamber over the carbonization cycle;

reducing a negative pressure draft on the horizontal heat recovery coke oven over a plurality of separate flow reducing steps, based on the plurality of temperature changes in the oven chamber.

22. The method of claim 21 wherein the negative pressure draft on the horizontal heat recovery coke oven draws air into the oven chamber through at least one air inlet, positioned to place the oven chamber in fluid communication with an environment exterior to the horizontal heat recovery coke oven.

23. The method of claim 21 wherein the negative pressure draft is reduced by actuation of an uptake damper associated with at least one uptake channel in fluid communication with the oven chamber.

24. The method of claim 23 wherein the negative pressure draft is reduced over a plurality of flow reducing steps by moving the uptake damper through a plurality of increasingly flow restrictive positions over the carbonization cycle, based on the plurality of different temperatures in the oven chamber.

25. The method of claim 21 further comprising:

increasing a temperature of at least one sole flue, which is in open fluid communication with the oven chamber, above a designed sole flue operating temperature for the horizontal heat recovery coke oven by reducing the negative pressure draft over a plurality of separate flow reducing steps, based on the plurality of temperature changes in the oven chamber.

26. The method of claim 21 wherein the bed of coal has a weight that exceeds a designed bed charge weight for the horizontal heat recovery coke oven; the oven chamber reaching a maximum crown temperature during the carbonization cycle that is less than a designed not to exceed maximum crown temperature for the horizontal heat recovery coke oven.

27. The method of claim 26 further comprising:

increasing a temperature of at least one sole flue, which is in open fluid communication with the oven chamber, above a designed sole flue operating temperature for the horizontal heat recovery coke oven by reducing the negative pressure draft over a plurality of separate flow reducing steps, based on the plurality of temperature changes in the oven chamber.

28. The method of claim 27 wherein the bed of coal has a weight that is greater than a designed coal charge weight for the horizontal heat recovery coke oven, defining a coal processing rate that is greater than a designed coal processing rate for the horizontal heat recovery coke oven.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. A system for controlling a horizontal heat recovery coke oven burn profile, the system comprising:

a horizontal heat recovery coke oven having (i) an oven chamber being at least partially defined by an oven floor, opposing oven doors, opposing sidewalls that extend upwardly from the oven floor between the opposing oven doors, and an oven crown positioned above the oven floor, (ii) at least one air inlet, and (iii) at least one sole flue, beneath the oven floor, in fluid communication with the oven chamber;

a temperature sensor disposed within the oven chamber;

at least one air inlet, positioned to place the oven chamber in fluid communication with an environment exterior to the horizontal heat recovery coke oven;

at least one uptake channel having an uptake damper in fluid communication with the at least one sole flue; the uptake damper being selectively movable between open and closed positions; and a controller operatively coupled with the uptake damper and temperature sensor, the controller being adapted to (i) receive a plurality of successively increasing temperature changes detected by the temperature sensor over a carbonization cycle inside the oven chamber, and (ii) move the uptake damper through a plurality of increasingly flow restrictive positions, until the temperature changes in the oven chamber reach a peak temperature, to gradually reduce a negative pressure draft over the increasingly flow restrictive positions of the uptake damper, whereby a rate at which the oven chamber attains the peak temperature during the carbonization cycle is reduced.

2. The system of claim 1, wherein the at least one air inlet includes at least one crown air inlet positioned in the oven crown above the oven floor.

3. The system of claim 2, wherein the at least one crown air inlet includes an air damper that is selectively movable between open and closed positions to vary a level of fluid flow restriction through the at least one crown air inlet.

4. The system of claim 1, wherein the controller is further operative to increase a temperature of the at least one sole flue above a designed sole flue operating temperature for the horizontal heat recovery coke oven by moving the uptake damper in a manner that reduces the negative pressure draft over a plurality of separate flow reducing steps, based on the plurality of temperature changes in the oven chamber.

5. The system of claim 1, wherein the controller is configured to move the uptake damper to:

one of the plurality of flow restrictive positions when a temperature of approximately 2200° F. to 2300° F. is detected;

another of the plurality of flow restrictive positions when a temperature of approximately 2400° F. to 2450° F. is detected;

another of the plurality of flow restrictive positions when a temperature of approximately 2500° F. is detected;

another of the plurality of flow restrictive positions when a temperature of approximately 2550° F. to 2625° F. is detected;

another of the plurality of flow restrictive positions when a temperature of approximately 2650° F. is detected; and another of the plurality of flow restrictive positions when a temperature of approximately 2700° F. is detected.

* * * * *